United States Patent [19]

Perry et al.

[11] Patent Number: 4,950,950

[45] Date of Patent: Aug. 21, 1990

[54] ELECTROLUMINESCENT DEVICE WITH SILAZANE-CONTAINING LUMINESCENT ZONE

[75] Inventors: Robert J. Perry, Pittsford; Ching W. Tang, Rochester, both of N.Y.

[73] Assignee: Eastman Kodak Company, Rochester, N.Y.

[21] Appl. No.: 353,832

[22] Filed: May 18, 1989

[51] Int. Cl.[5] ..... H05B 33/14

[52] U.S. Cl. ..... 313/504; 313/506; 428/690; 428/917

[58] Field of Search ..... 313/503, 504, 506; 428/690, 691, 917

[56] References Cited

U.S. PATENT DOCUMENTS

| | | | |
|---|---|---|---|
| 3,172,862 | 3/1965 | Gurnee et al. | 252/301.3 |
| 3,173,050 | 3/1965 | Gurnee | 313/108 |
| 3,359,445 | 12/1967 | Roth | 313/108 |
| 3,382,394 | 5/1968 | Mehl | 313/108 |
| 3,530,325 | 9/1970 | Mehl et al. | 313/108 |
| 3,621,321 | 11/1971 | Williams et al. | 313/108 A |
| 3,710,167 | 1/1973 | Dresner et al. | 313/108 A |
| 3,772,556 | 11/1973 | Williams | 313/108 A |
| 3,995,299 | 11/1976 | Partridge | 357/8 |
| 4,356,429 | 10/1982 | Tang | 313/503 |
| 4,539,507 | 9/1985 | Van Slyke et al. | 313/504 |
| 4,720,432 | 1/1988 | Van Slyke et al. | 428/457 |
| 4,769,292 | 9/1988 | Tang et al. | 313/504 X |
| 4,885,211 | 12/1989 | Tang et al. | 313/504 X |

OTHER PUBLICATIONS

Kawabe et al, "Electroluminescence of Green Light Region in Doped Anthracene", *Japan Journal of Applied Physics*, vol. 10, pp. 527–528, 2/1971.

Dresner, "Double Injection Electroluminescence in Anthracene", *RCA Review*, vol. 30, pp. 322–334, 6/1969.

*Primary Examiner*—Kenneth Wieder

*Attorney, Agent, or Firm*—Robert A. Linn

[57] ABSTRACT

An electroluminescent device having a luminescent zone of less than one millimicron (μm) in thickness comprised of an organic host material capable of sustaining hole-electron recombination. The hole-transporting agent is a silazane.

20 Claims, 1 Drawing Sheet

ELECTROLUMINESCENT DEVICE WITH SILAZANE-CONTAINING LUMINESCENT ZONE

FIELD OF THE INVENTION

This invention relates to organic electroluminescent devices. More specifically, this invention relates to devices which emit light from an organic layer positioned between anode and cathode electrodes when a voltage is applied across the electrodes.

BACKGROUND OF THE INVENTION

While organic electroluminescent devices have been known for about two decades, their performance limitations have represented a barrier to many desirable applications.

Gurnee et al U.S. Pat. No. 3,172,862, issued Mar. 9, 1965, filed Sept. 29, 1960, disclosed an organic electroluminescent device. (For brevity EL, the common acronym for electroluminescent, is sometimes substituted.) The EL device was formed of an emitting layer positioned in conductive contact with a transparent electrode and a metal electrode. The emitting layer was formed of a conjugated organic host material, a conjugated organic activating agent having condensed benzene rings, and a finely divided conductive material. Naphthalene, anthracene, phenanthrene, pyrene, benzopyrene, chrysene, picene, carbazole, fluorene, biphenyl, terphenyls, quaterphenyls, triphenylene oxide, dihalobiphenyl, trans-stilbene, and 1,4-diphenylbutadiene were offered as examples of activating agents, with anthracene being disclosed to impart a green hue and pentacene to impart a red hue. Chrome and brass were disclosed as examples of the metal electrode while the transparent electrode was disclosed to be a conductive glass. The phosphor layer was disclosed to be "as thin as possible, about 0.0001 inch"—i.e. 2.54 micrometers. Electroluminescence was reported at 800 volts and 2000 hertz.

Recognizing the disadvantage of employing high voltages and frequencies, Gurnee in U.S. Pat. No. 3,173,050 reported producing electroluminescence at 110 volts d.c. by employing in series with the emitting layer, an impedance layer capable of accounting for 5 to 50 percent of the voltage drop across the electrodes.

Modest performance improvements over Gurnee have been made by resorting to increasingly challenging device constructions, such as those requiring alkali metal cathodes, inert atmospheres, relatively thick monocrystalline anthracene phosphor elements, and/or specialized device geometries. Mehl U.S. Pat. No. 3,382,394, Mehl et al U.S. Pat. No. 3,530,325, Roth U.S. Pat. No. 3,359,445, Williams et al U.S. Pat. No. 3,621,321, Williams U.S. Pat. No. 3,772,556, Kawabe et al "Electroluminescence of Green Light Region in Doped Anthracene", *Japan Journal of Applied Physics*, Vol. 10, pp. 527–528, 1971, and Partridge U.S. Pat. No. 3,995,299 are representative.

In 1969 Dresner, "Double Injection Electroluminescence in Anthracene", *RCA Review*, Vol. 30, pp. 322–334, independently corroborated the performance levels of then state of the art EL devices employing thick anthracene phosphor elements, alkali metal cathodes, and inert atmospheres to protect the alkali metal from spontaneous oxidation. These EL devices were more than 30 μm in thickness, and required operating potentials of more than 300 volts. In attempting to reduce phosphor layer thickness and thereby achieve operation with potential levels below 50 volts, Dresner attempted to coat anthracene powder between a conductive glass anode and a gold, platinum or tellurium grid cathode, but phosphor layer thickness of less than 10 μm could not be successfully achieved because of pinholes.

Dresner U.S. Pat. No. 3,710,167 reported a more promising EL device employing (like Gurnee et al and Gurnee) a conjugated organic compound, but as the sole component of an emitting layer of less than 10 μm (preferably 1 to 5 μm) in thickness. A tunnel injection cathode consisting of aluminum or degenerate $N^+$ silicon with a layer of the corresponding aluminum or silicon oxide of less than 10 Angstroms in thickness, was employed.

More recent discoveries comprise EL device constructions with two extremely thin layers ($<1.0$ μm in combined thickness) separating the anode and cathode, one specifically chosen to transport holes and the other specifically chosen to transport electrons and acting as the organic luminescent zone of the device. This has allowed applied voltages to be reduced for the first time into ranges approaching compatibility with integrated circuit drivers, such as field effect transistors. At the same time light outputs at these low driving voltages have been sufficient to permit observation under common ambient lighting conditions.

For example, Tang U.S. Pat. No. 4,356,429 discloses in Example 1 an EL device formed of a conductive glass transparent anode, a 1000 Angstroms hole transporting layer of copper phthalocyanine, a 1000 Angstroms electron transporting layer of tetraphenylbutadiene in poly(styrene) also acting as the luminescent zone of the device, and a silver cathode. The EL device emitted blue light when biased at 20 volts at an average current density in the 30 to 40 $mA/cm^2$. The brightness of the device was 5 $cd/m^2$. Tang teaches useful cathodes to be those formed from common metals with a low work function, such as indium, silver, tin, and aluminum.

A further improvement in organic layer EL devices is taught by Van Slyke et al, U.S. Pat. No. 4,539,507. Referring to Example 1, onto a transparent conductive glass anode were vacuum vapor deposited successive 750 Angstrom hole transporting 1,1-bis(4-di-p-tolylaminophenyl)cyclohexane and electron transporting 4,4'-bis(5,7-di-t-pentyl-2-benzoxzolyl)stilbene layers, the latter also providing the luminescent zone of the device. Indium was employed as the cathode. The EL device emitted blue-green light (520 nm peak). The maximum brightness achieved 340 $cd/m^2$ at a current density of about 140 $mA/cm^2$ when the applied voltage was 22 volts. The maximum power conversion efficiency was about $1.4\times10^{-3}$ watt/watt, and the maximum EL quantum efficiency was about $1.2\times10^{-2}$ photon/electron when driven at 20 volts. Silver, tin, lead, magnesium, manganese, and aluminum are specifically mentioned for cathode construction.

Van Slyke et al U.S. Pat. No. 4,720,432, discloses an organic EL device comprised of, in the sequence recited, an anode, an organic hole injecting and transporting zone, an organic electron injecting and transporting zone, and a cathode. The organic EL device is further characterized in that the organic hole injecting and transporting zone is comprised of a layer in contact with the anode containing a hole injecting porphyrinic compound and a layer containing a hole transporting aromatic tertiary amine interposed between the hole injecting layer and the electron injecting and transporting zone.

Tang et al (I) U.S. Ser. No. 013,530, filed Feb. 11, 1987, now U.S. Pat. No. 4,885,211, commonly assigned, titled ELECTROLUMINESCENT DEVICE WITH IMPROVED CATHODE, discloses an EL device comprised of a cathode formed of a plurality of metals other than alkali metals, at least one of which has a work function of less than 4 eV.

Tang et al, (II) U.S. Pat. No. 4,769,292 discloses an electroluminescent device with a modified thin film luminescent zone. The luminescent zone is less than 1 μm in thickness, and comprises an organic host material forming a layer capable of sustaining both hole and electron injection. In the layer is a dye capable of emitting light in response to hole-electron recombination. The dye has a band gap no greater than that of the host material and a reduction potential less negative than the host material. The dye can be selected from coumarin, dicyanomethylenepurans and thiopyrans, polymethine, oxabenzanthacene, xanthene, pyrilium, thiapyrilium, carbostyril, and perylene fluorescent dyes.

SUMMARY OF THE INVENTION

Although recent performance improvements in organic EL devices have suggested a potential for widespread use, most practical applications require limited voltage input or light output variance over an extended period of time. Consequently, the limited thermal stability of materials within many prior art devices has remained a deterrent to widespread use. Device degradation results in obtaining progressively lower current densities when a constant voltage is applied. Lower current densities in turn result in lower levels of light output. With a constant applied voltage, practical EL device use terminates when light emission levels drop below acceptable levels—e.g., readily visually detectable emission levels in ambient lighting. If the applied voltage is progressively increased to hold light emission levels constant, the field across the EL device is correspondingly increased. Eventually a voltage level is required that cannot be conveniently supplied by the EL device driving circuitry, or which produces a field gradient (volts/cm) exceeding the dielectric breakdown strength of the layers separating the electrodes, resulting in a catastrophic failure of the EL device.

It has been discovered quite surprisingly that stability and sustained operating performance of the organic EL device of Van Slyke et al, cited above, can be markedly improved by forming the hole transporting zone of the organic luminescent medium to contain a silazane hole transporting agent.

In one aspect this invention is directed to an electroluminescent device comprising in sequence, an anode, an organic hole injecting and transporting zone, an electron injecting and transporting zone, and a cathode, characterized in that the organic hole transporting zone is comprised of a layer containing a hole transporting silazane in contact with the anode and interposed between the hole injecting layer and the electron injecting and transporting zone.

When organic EL devices according to this invention are constructed with cathodes formed of a plurality of metals other than alkali metals, at least one of the metals having a work function of less than 4 eV, as taught by Tang et al (I), cited above, further advantages are realized.

Therefore, in another aspect this invention is directed to an electroluminescent device comprising in sequence, an anode, an organic hole injecting and transporting zone, an organic electron injecting and transporting zone, and a cathode, characterized in that (1) the organic hole transporting zone is comprised of a layer in contact with the anode containing a hole transporting silazane or polysilazane interposed between the hole injecting layer and the electron injecting and transporting zone and (2) the cathode is comprised of a layer consisting of a plurality of metals other than alkali metals, at least one of the metals having a work function of less than 4 eV.

In addition to the stability advantages of the organic luminescent medium discussed above, the combination of a low work function metal and at least one other metal in the cathode of an organic EL device results in improving the stability of the cathode and consequently the stability of the device. It has been observed that the initial performance advantages of low work function metals other than alkali metals as cathode materials are only slightly diminished when combined with more stable, higher work function metals while marked extensions of EL device lifetimes are realized with even small amounts of a second metal being present. Further, the advantages in extended lifetimes can be realized even when the cathode metals are each low work function metals other than alkali metals. Additionally, the use of combinations of metals in forming the cathodes of the organic EL devices of this invention may confer advantages in fabrication, such as improved acceptance by the electron transporting organic layer during vacuum vapor deposition of the cathode.

Another advantage realized with the cathode metal combinations of this invention is that low work function metals can be employed to prepare cathodes which are light transmissive and at the same time exhibit low levels of sheet resistance. Thus, the option is afforded of organic EL device constructions in which the anode need not perform the function of light transmission, thereby affording new use opportunities for organic EL devices.

In still another more preferred aspect, this invention is directed to an electroluminescent device comprising in sequence, an anode, an organic hole injecting and transporting zone, a luminescent zone, and a cathode, characterized in that (1) the organic hole transporting zone is comprised of a layer in contact with the anode containing a hole transporting silazane or polysilazane interposed between the hole injecting layer and the luminescent zone, and (2) the luminescent zone is formed by a thin film of less than 1 μm in thickness comprised of an organic host material capable of sustaining hole and electron injection and a fluorescent material capable of emitting light in response to hole-electron recombination.

The presence of the fluorescent material permits a choice from among a wide latitude of wavelengths of light emission. By selection of the materials forming the thin film organic EL devices of this invention, including particularly any one or combination of the fluorescent materials, the cathode metals, and the hole stable injecting and transporting materials, more device operation can be achieved than has been heretofore realized.

BRIEF DESCRIPTION OF THE DRAWINGS

These and other advantages of the present invention can be better appreciated by reference to the following detailed description considered in conjunction with the drawings, in which.

The drawings are necessarily of a schematic nature, since the thicknesses of the individual layers are too thin and thickness differences of the various device elements too great to permit depiction to scale or to permit proportionate scaling.

DESCRIPTION OF PREFERRED EMBODIMENTS

Figure 1:
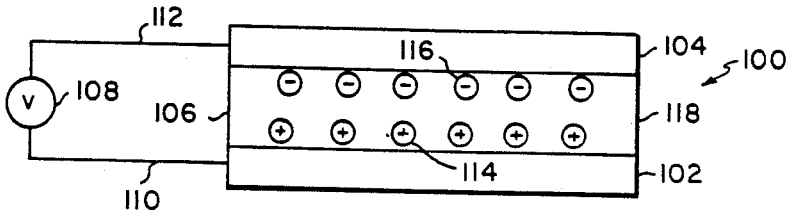
FIGS. 1, 2, and 3 are schematic diagrams of EL devices.

An electroluminescent or EL device 100 according to the invention is schematically illustrated in FIG. 1. Anode 102 is separated from cathode 104 by an organic luminescent medium 106. The anode and the cathode are connected to an external power source 108 by conductors 110 and 112, respectively. The power source can be a continuous direct current or alternating current voltage source or an intermittent current voltage source. Any convenient conventional power source, including any desired switching circuitry, can be employed which is capable of positively biasing the anode with respect to the cathode. Either the anode or cathode can be at ground potential.

The EL device can be viewed as a diode which is forward biased when the anode is at a higher potential than the cathode. Under these conditions the anode injects holes (positive charge carriers), schematically shown at 114, into the luminescent medium while the cathode injects electrons, schematically shown at 116, into the luminescent medium. The portion of the luminescent medium adjacent the anode thus forms a hole injecting and transporting zone while the portion of the luminescent medium adjacent the cathode forms an electron injecting and transporting zone. The injected holes and electrons each migrate toward the oppositely charged electrode. This results in hole-electron recombination within the organic luminescent medium. When a migrating electron drops from its conduction band to a valence band in filling a hole, energy is released as light. Hence the organic luminescent medium forms between the electrodes a luminescence zone receiving mobile charge carriers from each electrode. Depending upon the choice of alternative constructions, the released light can be emitted from the luminescent material through one or more of edges 118 separating the electrodes, through the anode, through the cathode, or through any combination of the foregoing.

Reverse biasing of the electrodes reverses the direction of mobile charge migration, interrupts charge injection, and terminates light emission. The most common mode of operating organic EL devices is to employ a forward biasing d.c. power source and to rely on external current interruption or modulation to regulate light emission.

In the organic EL devices of the invention it is possible to maintain a current density compatible with efficient light emission while employing a relatively low voltage across the electrodes by limiting the total thickness of the organic luminescent medium to less than 1 μm (10,000 Angstroms). At a thickness of less than 1 μm an applied voltage of 20 volts results in a field potential of greater than $2\times10^5$ volts/cm, which is compatible with efficient light emission. As more specifically noted below, preferred thicknesses of the organic luminescent medium are in the range of from 0.1 to 0.5 μm (1,000 to 5,000 Angstroms), allowing further reductions in applied voltage and/or increase in the field potential, are well within device construction capabilities.

Since the organic luminescent medium is quite thin, it is usually preferred to emit light through one of the two electrodes. This is achieved by forming the electrode as a translucent or transparent coating, either on the organic luminescent medium or on a separate translucent or transparent support. The thickness of the coating is determined by balancing light transmission (or extinction) and electrical conductance (or resistance). A practical balance in forming a light transmissive metallic electrode is typically for the conductive coating to be in the thickness range of from about 50 to 250 Angstroms. Where the electrode is not intended to transmit light, any greater thickness found convenient in fabrication can also be employed.

Figure 2:
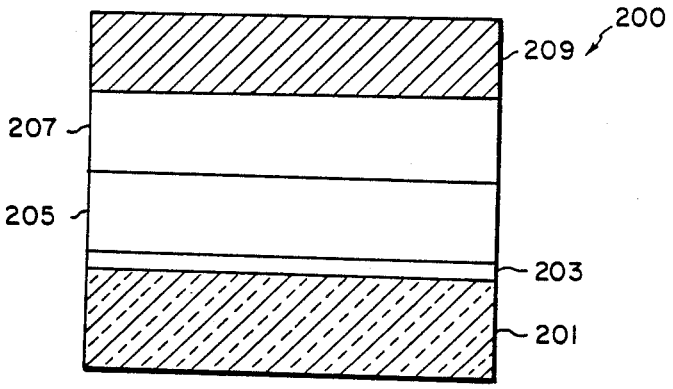

Organic EL device 200 shown in FIG. 2 is illustrative of one preferred embodiment of the invention. Because of the historical development of organic EL devices it is customary to employ a transparent anode. This has been achieved by providing a transparent insulative support 201 onto which is deposited a conductive relatively high work function metal or metal oxide transparent layer to form anode 203. Since the portion of the organic luminescent medium immediately adjacent the anode acts as a hole transporting zone, the organic luminescent medium is preferably formed by depositing on the anode a layer 205 of an organic material chosen for its hole transporting efficiency. In the orientation of the device 200 shown, the portion of the organic luminescent medium adjacent its upper surface constitutes an electron transporting zone and is formed of a layer 207 of an organic material chosen for its electron transporting efficiency. With preferred choices of materials, described below, forming the layers 205 and 207, the latter also forms the zone in which luminescence occurs. The cathode 209 is conveniently formed by deposition on the upper layer of the organic luminescent medium.

Figure 3:
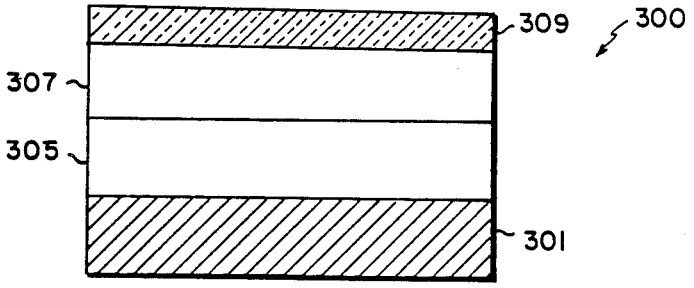

Organic EL device 300 shown in FIG. 3 is illustrative of another preferred embodiment of the invention. Contrary to the historical pattern of organic EL device development, light emission from the device 300 is through the light transmissive (e.g., transparent or substantially transparent) cathode 309. While the anode of the device 300 can be formed identically as the device 200, thereby permitting light emission through both anode and cathode, in the preferred form shown the device 300 employs an opaque charge conducting element to form the anode 301, such as a relatively high work function metallic substrate. The hole and electron transporting layers 305 and 307 can be identical to the corresponding layers 205 and 207 of the device 200 and require no further description. The significant difference between devices 200 and 300 is that the latter employs a thin, light transmissive (e.g., transparent or substantially transparent) cathode in place of the opaque cathode customarily included in organic EL devices.

Viewing organic EL devices 200 and 300 together, it is apparent that the present invention offers the option of mounting the devices on either a positive or negative polarity opaque substrate. While the organic luminescent medium of the EL devices 200 and 300 are described above as being comprised of a single organic hole injecting and transporting layer and a single electron injecting and transporting layer, further elaboration of each of these layers into multiple layers, as more specifically described below, can result in further enhancement of device performance. When multiple electron injecting and transporting layers are present, the layer receiving holes is the layer in which hole-electron recombination occurs and therefore forms the luminescent zone of the device.

In the practice of the present invention the luminescent zone is in every instance formed by a thin film (herein employed to mean less than 1 μm in thickness) comprised of an organic host material capable of sustaining hole and electron injection and a fluorescent material capable of emitting light in response to hole-electron recombination. It is preferred that the luminescent zone be maintained in a thickness range of from 50 to 5000 Angstroms and, optimally, 100 to 1000 Angstroms, so that the entire organic luminescent medium can be less than 1 μm and preferably less than 1000 Angstroms in thickness.

The host material can be conveniently formed of any material heretofore employed as the active component of a thin film luminescent zone of an organic EL device. Among host materials suitable for use in forming thin films are diarylbutadienes and stilbenes, such as those disclosed by Tang U.S. Pat. No. 4,356,429, cited above.

Optical brighteners of the type disclosed by Van Slyke and Tang in U.S. Pat. No. 4,539,507 can also be used as host material in this invention. The description of optical brighteners in said U.S. Pat. No. 4,539,507 is incorporated by reference herein as if fully set forth.

Particularly preferred host materials for forming the luminescent zone of the organic EL devices of this inventions are metal chelated oxinoid compounds, including chelates of oxine (also commonly referred to as 8-quinolinol or 8-hydroxyquinoline). Such compounds exhibit both high levels of performance and are readily fabricated in the form of thin films. Exemplary of contemplated oxinoid compounds are those satisfying structural formula (III):

(III)

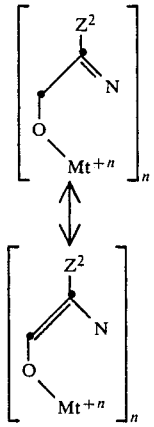

wherein

Mt represents a metal;

n is an integer of from 1 to 3; and $Z^2$ independently in each occurrence represents the atoms completing a nucleus having at least two fused aromatic rings.

From the foregoing it is apparent that the metal can be monovalent, divalent, or trivalent metal. The metal can, for example, be an alkali metal, such as lithium, sodium, or potassium; an alkaline earth metal, such as magnesium or calcium; or an earth metal, such as boron or aluminum. Generally any monovalent, divalent, or trivalent metal known to be a useful chelating metal can be employed.

$Z^2$ completes a heterocyclic nucleus containing at least two fused aromatic rings, at one of which is an azole or azine ring. Additional rings, including both aliphatic and aromatic rings, can be fused with the two required rings, if required. To avoid adding molecular bulk without improving on function the number of ring atoms is preferably maintained at 18 or less.

Illustrative of useful host materials capable of being used to form thin films are the following:

HM-1 Aluminum trisoxine [a.k.a., tris(8-quinolinol) aluminum]

HM-2 Magnesium bisoxine [a.k.a., bis(8-quinolinol) magnesium]

HM-3 Bis[benzo{f}-8-quinolinol]zinc

HM-4 Bis(2-methyl-8-quinolinolato) aluminum oxide

HM-5 Indium trisoxine [a.k.a., tris(8-quinolinol) indium]

HM-6 Aluminum tris(5-methyloxine) [a.k.a., tris(5-methyl-8-quinolinol) aluminum]

HM-7 Lithium oxine [a.k.a., 8-quinolinol lithium]

HM-8 Gallium trisoxine [a.k.a., tris(5-chloro-8-quinolinol) gallium]

HM-9 Calcium bis(5-chlorooxine) [a.k.a., bis(5-chloro-8-quinolinol) calcium]

HM-10 Poly[zinc (II)-bis(8-hydroxy-5-quinolinyl)methane]

HM-11 Dilithium epindolidione

HM-12 1,4-Diphenylbutadiene

HM-13 1,1,4,4-Tetraphenylbutadiene

HM-14 4,4'-Bis[5,7-di(t-pentyl-2-benzoxazolyl]stilbene

HM-15 2,5-Bis[5,7-di(t-pentyl-2-benzoxazolyl]thiophene

HM-16 2,2'-(1,4-phenylenedivinylene)bisbenzothiazole

HM-17 4,4'-(2,2'-Bisthiazolyl)biphenyl

HM-18 2,5-Bis[5-(α,α-dimethylbenzyl)-2-benzoxazolyl]thiophene

HM-19 2,5-Bis[5,7-di(t-pentyl)-2-benzoxazolyl]-3,4-diphenylthiophene

HM-20 Trans-stilbene

All of the host materials listed above are known to emit light in response to hole and electron injection. By blending with the host material a minor amount of a fluorescent material capable of emitting light in response to hole-electron recombination the hue of light emitted from the luminescent zone can be modified. In theory, if a host material and a fluorescent material could be found for blending which have exactly the same affinity for hole-electron recombination each material should emit light upon injection of holes and electrons in the luminescent zone. The perceived hue of light emission would be the visual integration of both emissions.

The host materials useful in this invention may also contain a fluorescent dye (or mixture thereof) as taught in Tang U.S. Pat. No. 4,769,292. The discussion of the use of fluorescent dyes in that patent is incorporated by reference herein as if fully set forth.

The organic luminescent medium of the EL devices of this invention preferably contains at least two separate organic layers, at least one layer forming a zone for transporting electrons injected from the cathode and at least one layer forming a zone for transporting holes injected from the anode. As is more specifically taught by Van Slyke et al U.S. Ser. No. 013,528, filed Feb. 11, 1987, now U.S. Pat. No. 4,720,432, commonly assigned, titled ELECTROLUMINESCENT DEVICE WITH ORGANIC LUMINESCENT MEDIUM, cited above, the latter zone is in turn preferably formed of at least two layers, one, located in contact with the anode, providing a hole injecting zone and the remaining layer, interposed between the layer forming the hole injecting zone and the layer providing the electron transporting zone, providing a hole transporting zone. While the description which follows is directed to the preferred embodiments of organic EL devices according to this invention which employ at least three separate organic layers, as taught by Van Slyke et al, it is appreciated that either the layer forming the hole injecting zone or the layer forming the hole transporting zone can be omitted and the remaining layer will perform both functions. Higher initial and sustained performance levels of the organic EL devices of this invention are realized when the separate hole injecting and hole transporting layers described below are employed in combination.

A layer containing a porphyrinic compound forms the hole injecting zone of the organic EL device. A porphyrinic compound is any compound, natural or synthetic, which is derived from or includes a porphyrin structure, including porphine itself. Any of the porphyrinic compounds disclosed by Adler U.S. Pat. No. 3,935,031 or Tang U.S. Pat. No. 4,356,429, the disclosures of which are here incorporated by reference, can be employed.

Preferred porphyrinic compounds are those of structural formula (IV):

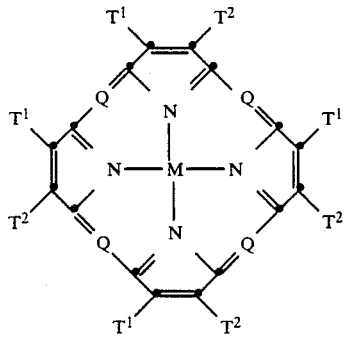

(IV)

wherein

Q is —N= or —C(R)=;

M is a metal, metal oxide, or metal halide;

R is hydrogen, alkyl, aralkyl, aryl, or alkaryl, and $T^1$ and $T^2$ represent hydrogen or together complete a unsaturated 6 membered ring, which can include substituents, such as alkyl or halogen. Preferred 6 membered rings are those formed of carbon, sulfur, and nitrogen ring atoms. Preferred alkyl moieties contain from about 1 to 6 carbon atoms while phenyl constitutes a preferred aryl moiety.

In an alternative preferred form the porphyrinic compounds differ from those of structural formula (IV) by substitution of two hydrogen for the metal atom, as indicated by formula (V):

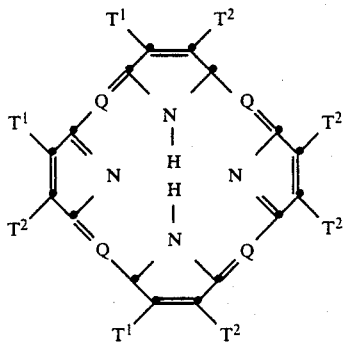

(V)

Highly preferred examples of useful porphyrinic compounds are metal free phthalocyanines and metal containing phthalocyanines. While the porphyrinic compounds in general and the phthalocyanines in particular can contain any metal, the metal preferably has a positive valence of two or higher. Exemplary preferred metals are cobalt, magnesium, zinc, palladium, nickel, and, particularly, copper, lead, and platinum.

Illustrative of useful porphyrinic compounds are the following:

PC-1 Porphine
PC-2 1,10,15,20-Tetraphenyl-21H,23H-porphine copper (II)
PC-3 1,10,15,20-Tetraphenyl-21H,23H-porphine zinc (II)
PC-4 5,10,15,20-Tetrakis(pentafluorophenyl)-21H,23H-porphine
PC-5 Silicon phthalocyanine oxide
PC-6 Aluminum phthalocyanine chloride
PC-7 Phthalocyanine (metal free)
PC-8 Dilithium phthalocyanine
PC-9 Copper tetramethylphthalocyanine
PC-10 Copper phthalocyanine
PC-11 Chromium phthalocyanine fluoride
PC-12 Zinc phthalocyanine
PC-13 Lead phthalocyanine
PC-14 Titanium phthalocyanine oxide
PC-15 Magnesium phthalocyanine
PC-16 Copper octamethylphthalocyanine The hole transporting layer of this invention contains at least one silazane, i.e. a compound having one or more silicon-nitrogen bonds. The silazane(s) are used as hole transporting agents. Preferably, the silazanes are oxidizable with an election potential in the range of 0.5–1.2 electron volts. It is also preferred that the molecular orbital of the ground state radical cation derived from the neutral silazane, be sufficiently diffuse to enhance good orbital overlap between the radical and adjacent neutral silazane molecules.

One class of preferred silazanes useful in this invention has the cyclodisilazane nucleus:

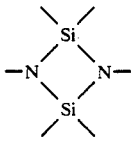

(V)

The cyclodisilazane nucleus is highly planar. Without being bound by any theory, it is believed that the planarity significantly contributes to the hole transporting properties exhibited by such compounds.

The nitrogen and silicon atoms in the disilazane ring are preferably bonded to organic groups. The groups bonded to the silicon and nitrogen atoms are discussed below.

The groups bonded to the nitrogen atoms in the disilazane ring can be selected from alkyl and aryl groups having up to about 14 carbon atoms. These groups may be solely composed of carbon or hydrogen, or they have other substituents which do not interfere with the electronic properties necessary for hole transport. Preferably the radicals bonded to the nitrogen atoms in the disilazane ring are aryl groups.

The aryl groups bonded to the nitrogen atoms in the cyclodisilazane ring may be alike or different. Preferably the ring bonded to the silazane nitrogen is coplanar, or substantially coplanar, with the cyclodisilazane ring. It appears that such a configuration enhances the hole transporting properties of the disilazane.

For the purpose of this invention, "substantially coplanar" means that the aromatic ring is in a plane that is up to about 15° different from the plane of the cyclodisilazane ring. There should not be two organic substituents bonded to the carbon atoms which are adjacent, i.e. ortho, to the carbon atom bonded to the ring nitrogen in the cyclodisilazane. One ortho substituent can usually be present, unless it is so bulky as to make it necessary for the aryl group to appreciably tilt with respect to the cyclodisilazane ring, in order to be bonded thereto.

Above it was stated that the groups which can be bonded to the nitrogen atoms in the disilazane ring can contain atoms other than carbon and hdyrogen. Thus, for example, the aryl groups may contain an amino radical

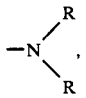

wherein each R is an alkyl or aryl group having up to about 14 carbon atoms. More preferably, each R in the amino group is an aryl radical.

The aryl radicals bonded to the nitrogen in the amino group may be the same or different from the aryl groups bonded to the nitrogen in the cyclodisilazane ring.

Preferably, the amino group is in a para position to an aryl ring bonded directly (or through another ring) to the nitrogen atom in the cyclodisilazane ring.

Generally speaking, aryl groups bonded to the nitrogen atoms in the cyclodisilazane ring enhance the hole transporting properties of the cyclodisilazanes. For this reason it is preferred that the ring nitrogens be bonded to aryl groups.

Preferably, each ring nitrogen in the cyclodisilazane ring is bonded to a 4-diphenylyl radical.

Substituents bonded to the silicon atoms in the cyclodisilazane ring may be selected from alkyl and aryl groups having up to about 14 carbon atoms. In order to confer mechanical stability to the cyclodisilazane layers employed in this invention, it is preferred that each disilazane ring have from about 4 to about 8 aryl rings; more preferably 4 to 8 phenyl or substituted phenyl moieties. When the aryl groups bonded to the nitrogen atoms in the cyclodisilazane ring do not have that many aryl groups, it is preferred that enough aryl rings be bonded to the silicon atoms so that each cyclodisilazane ring has from about 4 to 8 aryl rings.

A particularly preferred class of cyclodisilazanes has the formula:

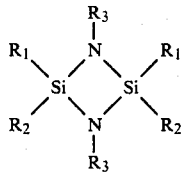

(VI)

when $R_1$–$R_3$ are defined below. In this class of compounds, it is preferred that both radicals designated by the same subscript in formula (VI) be the same, since such compounds are generally more readily available. However, a skilled practitioner will recognize that symmetry is not necessary, and that unsymmetrical compounds can also be used in this invention.

The radicals bonded to silicon in the compounds of formula (VI), i.e., radicals $R_1$ and $R_2$, are preferably organic groups. More preferably, they are either hydrocarbyl groups, i.e., groups composed solely of carbon and hydrogen, or substituted hydrocarbyl groups. Representative hydrocarbyl groups are alkyl, cycloalkyl, aryl, alkaryl, and aralkyl groups having up to about 14 carbon atoms. Phenyl and naphthyl rings may be present in the aryl, alkaryl and aralkyl groups represented by substituents $R_1$ and $R_2$.

In a preferred embodiment, it is preferred that the $R_1$ and $R_2$ radicals in formula (VI) be the same. It is also preferred that they be selected from lower alkyl radicals having up to about 6 carbon atoms, and the phenyl and substituted phenyl radicals having up to about 10 carbon atoms. A highly preferred lower alkyl radical is the methyl radical. The phenyl radical is also highly preferred.

In a highly preferred embodiment, there are at least two aryl groups e.g., phenyl, bonded to the nitrogen atoms in the cyclodisilazane ring. Cyclodisilazane compounds of this type are illustrated by the following:

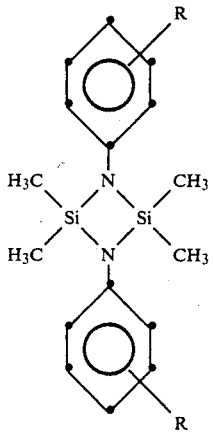

(VI-A)

wherein R is equal to hydrogen, or lower alkyl, i.e., alkyl groups having 1–4 carbon atoms, or —$OCH_3$, or NR'R', wherein R' is H, or lower alkyl, phenyl, or the like;

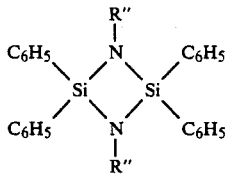

(VI-B)

wherein $C_6H_5$ is the phenyl radical and R'' is the same type of radical attached to the nitrogen atoms in formula (VI-A);

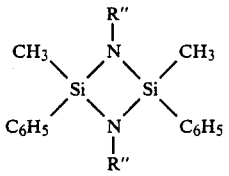

(VI-C)

wherein $C_6H_5$— and R'' are as defined above, and (VI-D)

wherein R is as defined in (VI-A) above, R' is as defined in (VI-A) and (VI-B) above, and R'' is lower alkyl, phenyl, and the like. Compounds similar to those within formulas (VI-A), (VI-B), (VI-C) and (VI-D), wherein one or more of the phenyl radicals is or are replaced with a naphthyl radical, or other carbocyclic fused ring system, are also preferred hole transporting agents of this invention.

A highly preferred class of cyclodisilazanes useful as hole transporting agents of this invention have the formula:

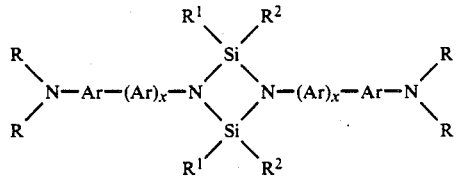

(VII)

wherein each Ar is an aryl radical having from 6 to about 14 carbon atoms, x is a whole number selected from 0 and 1, and R, $R^1$, and $R^2$ are alkyl or aryl radicals having up to about 14 carbon atoms. Preferably Ar is a phenyl radical, each x is equal to 1, each R is a phenyl radical, and $R^1$ and $R^2$ are selected from methyl and phenyl radicals.

Compounds of the type illustrated by Formula (VII) can be prepared by reacting the corresponding amine with a dihalosilane in the presence of a base to form an intermediate, which is subsequently reacted with an alkyl lithium, and another portion of the dihalosilane. This process is illustrated below by the following equations and Example C, which follows.

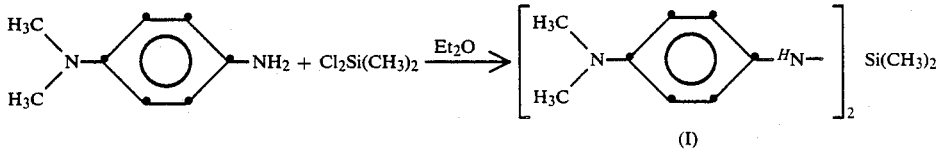

(a)

(I)

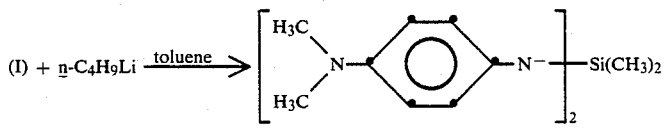

(b)

(II)

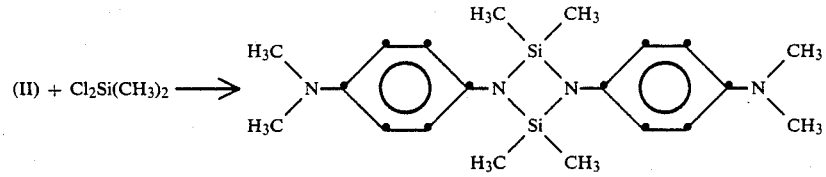

(c)

EXAMPLE A

N,N'-bis(4-dimethylaminophenyl)tetramethylcyclodisilazane was prepared in the following manner.

N,N-dimethyl-1,4-phenylenediamine (40.0 g, 284 mmol) and triethylamine ($Et_3N$, 45 ml, 323 mmol) were dissolved in 700 mL dry diethylether ($Et_20$) under an argon atmosphere. Then dichlorodimethylsilane (17.3 mL, 142 mmol) was added dropwise over 5 minutes. The exothermic reaction caused the ether to reflux. The mixture was stirred for 3 hours without any external heating followed by 18 hours at reflux. The reaction mixture was then cooled to room temperature, filtered under nitrogen and the precipitate washed with dry ether. The ether filtrates were combined, concentrated in vacuo, and distilled to give 32.0 g (69%) of the intermediate N,N'-bis(4-dimethylaminophenyl)-diaminodimethyl silane; bp. 196°-203° C./0.15 torr. $^1H$ NMR ($CDCl_3$) δ0.44 (s, $CH_3$, 6), 2.88 (s, N—$CH_3$, 12), 3.48 (s, NH, 2), 6.75 (m, Ar—H,4), 6.85 (m, Ar—H, 4). IR (neat) 3360, 2960, 2790, 1520, 1445, 1285, 1260, 1055, 945, 915, 815 $cm^{-1}$.

The intermediate described above (27.7 g, 84.3 mmol) was dissolved in dry toluene (1000 mL), cooled in an ice bath, and then treated dropwise with n-butyllithium (69 mL of 2.5M solution is mixed hexanes, 171 mmol) over 15 minutes. The ice bath was removed and the mixture stirred at room temperature for 2.5 hours and then heated to 50° C. for 0.5 hours. The heat was removed and dichlorodimethylsilane (10.2 mL, 84 mmol) was added over 5 minutes. The reaction was stirred for 0.5 hours at room temperature and then brought to reflux and stirred for an additional 16 hours. The mixture was filtered warm and the filtrate concentrated. The solid that was isolated was recrystallized from heptane to give 10.3 g (32%) of product as very slightly purple-white crystals. mp.232°-234° C. $^1$H NMR ($CDCl_3$)δ0.60 (s,$CH_3$, 12), 2.85 (s, N—$CH_3$, 12), 6.60 (d, J=8.7 Hz, Ar—H, 4), 6.75 (d, J=8.7 Hz, Ar—H, 4). IR (KBr) 2945, 2820, 2780, 1515, 1290, 1250, 1205, 1135, 960, 900, 820, 795,. Anal. Calcd for $C_{20}H_{32}N_4Si$: C, 62.45; H, 8.38; N, 14.56. Found: C, 62.76; H, 8.24; N, 14.63.

The compound, N,N'-bis(4-diphenylaminophenyl)-tetraphenylcyclodisilazane, can be made by reacting N,N-diphenyl-4,4'-phenylenediamine with dichlorodiphenylsilane using the procedure illustrated above. Similar compounds can also be made using this method.

Cyclodisilazanes useful in this invention include the monomeric cyclodisilazanes described above, and polymeric compounds. Polymeric materials with the cyclodisilazane nucleus useful in this invention have a plurality of precursor residues, each having repeating units of the formula:

(VIII)

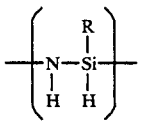

said residues being linked together by $Si_2N_2$ bridges having the formula:

(IX)

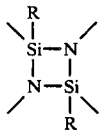

wherein R is selected from hydrogen, lower alkyl groups having from 1 to about 6 carbon atoms, lower alkoxy groups having from 1 to about 6 carbon atoms, substituted or unsubstituted vinyl groups, substituted or unsubstituted lower aryl groups having from 6 to about 10 carbon atoms, tri(lower)alkyl and di(lower)alkysilyl groups and di(lower)alkylamino groups; and n is an integer greater than 1 (preferably from about 3 to about 12); said residue being cyclic, linear or branched. Cyclic and linear residues are depicted by Seyferth et al. Branched residues, e.g.,

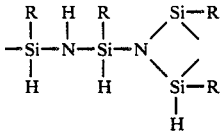

may be present in linear products prefaced by the process of Seyferth et al. Branched structures are discussed by Seyferth et al in *Polymer Preprint* 25, (1984)p. 10.

Such polymers are ladder-like or planar array structures. They are described in Seyferth et al, U.S. Pat. No. 4,482,669. The description of those polymers and their preparation within that patent is incorporated by reference herein as if fully set forth. The following Example illustrates the preparation of a polymeric silazane by a procedure in general accordance with the procedure described in U.S. Pat. No. 4,482,699:

EXAMPLE B

Phenylidichlorosilane (40.0 ml, 274 mmol) was dissolved in dry either (600 ml) in a one-liter, 3-neck round-bottom flask equipped with a mechanical stirrer, cold finger condenser and a gas inlet. The solution was cooled to ice-bath temperature and excess anhydrous ammonia was bubbled in at the rate of 300–400 ml/min over three hours. The mixture was warmed to room temperature and the excess ammonia allowed to evaporate. The mixture was filtered under nitrogen and the solid washed with ether. The ether washings and filtrate were combined and concentrated in vacuo to give a slightly cloudy oligomer. This oligomer (24.7 g, 204 mmol) was added over 20 minutes to a slurry of KH (200 mg, 5 mmol) in THF (300 ml) under argon and stirred at room temperature. There was an initial vigorous evolution of hydrogen gas which subsided with time. After 3.5 hours, the reaction was quenched with methyl iodide (5 ml) and stirred for an additional hour. The solution was concentrated to ca. 15% of its original volume then diluted with hexane (100 ml) and filtered through a diatomaceous earth filter aid. The filtrate was concentrated and dried in vacuo to give a white solid (10 g, 41%) which was soluble in common organic solvents such as THF, hexane and toluene. Thermogravimetric analysis (TGA) in nitrogen gave a 65% ceramic yield at 1000° C. Size exclusion chromatography (SEC) gave Mn=2040 and Mw=2335 indicative of low molecular weight.

A poly(alkylsilazane) e.g. a poly(methylsilazane) can be made in the same manner. Thus, a polymer with precursor residues having repeating units (VIII) linked by bridges (IX) wherein each R is as described above using the above, can be made by using the above procedure with the appropriate starting materials. For a general discussion of the polymeric silazanes and their preparation, reference is made to Seyferth, supra.

EXAMPLE C

N,N'-bis(4-di-p-tolyaminophenyl)tetramethylcyclodisilzane was prepared in the following manner.

In a 250 ml round bottom flask equipped with a Teflon coated stir-bar, a reflux condenser and an argon inlet were placed 4-(di-p-tolylamino)aniline (3.5 g, 12.1 mmol), triethylamine (2.0 ml, 14.5 mmol) and dry ether (60 ml). When dissolution was complete dichlorodimethylsilane (735 μ, 6.1 mol) was added by syringe and then the reaction mixture was heated to gentle reflux for 21 hours. The mixture was then cooled to room temperature, filtered under nitrogen, the solid washed with ether and the ether layers combined and concentrated in vacuo to give a solid. This solid was subjected to kugelrohr distillation to remove any remaining starting material. The residue left in the flask after distillation (170 C/0.1 torr) was the intermediate N,N'-bis(4-di-p-tolyaminophenyl)diaminodimethylsilane. $^1$H NMR ($CDCl_3$) δ0.43(s, Si—$CH_3$,6), 2.29(s, $CH_3$,12), 3.60(s, NH, 2), 6.72(d, J=8.7 Hz, 4), 6.90(d, J=8.7 Hz, 4), 6.93(d,J=8.4 Hz, 8), 7.01(d,J=8.4 Hz, 8). IR(KBr) 3430, 3360, 3020, 2920, 1605, 1500, 1320, 1260, 815 565 $cm^{-1}$. Anal. Calcd. for $C_{42}H_{44}N_4Si$: C, 79.70; H, 7.01; N, 8.85. Found: C, 78.91; H, 7.13; N, 8.83.

To the intermediate described above (1.76 g, 2.74 mmol) dissolved in xylenes (60 ml) under argon at room temperature was added n-butyllithium (3.4 ml of 1.6M in hexanes, 5.47 mmol). The dark solution was stirred at room temperature for 30 minutes then heated to 55° C. for 30 minutes and then cooled again to room temperature. Dichlorodimethylsilane (330 82 l, 2.74 mmol) was added and the mixture stirred for 30 minutes. The temperature was slowly raised to reflux and the reaction mixture allowed to react for 20 hours. The mixture was then concentrated in vacuo and the residue slurried and washed with pentane. The resulting solid was isolated by filtration to give 1.58 g (83%) crude product. The solid was dissolved in chloroform and the small amount of insoluble material removed by centrifugation. The chloroform solution was concentrated to give 1.4 g product (74%). $^1H$ NMR ($CDCl_3$) δ0.62 (s, Si—$CH_3$, 12), 2.30(s, $CH_3$, 12), 6.53(d, J=8.7 Hz, 4), 6.95(d, j=8.7 Hz, 4), 6.96(d, j=8.4 Hz, 8), 7.02(d, J=8.4 Hz, 8). Anal. Calcd. for $C_{44}H_{48}N_4Si_2$: C, 76.70; H, 7.02; N, 8.13 Found: C, 75.49; H, 6.91; N, 7.81.

The various alkyl, alkylene, aryl, and other moieties of the foregoing structural formulae (V), (VI), and (VI-A,B,C) and (VII) can be substituted. Typical substituents including alkyl groups, alkoxy groups, aryl groups, aryloxy groups, amino, and halogen such as fluoride, chloride, and bromide. The various alkyl and alkylene moieties typically contain from about 1 to 6 carbon atoms. The cycloalkyl moieties can contain from 3 to about 10 carbon atoms, but typically contain five, six, or seven ring carbon atoms—e.g., cyclopentyl, cyclohexyl, and cycloheptyl ring structures. The aryl ring is preferably selected from phenyl and phenylene moieties.

Illustrative disilazanes useful in this invention are the following:

| | |
|---|---|
| DSC-1 | N,N'-diphenyltetramethylcyclodisilazane |
| DSC-2 | Hexaphenylcyclodisilazane |
| DSC-3 | N,N'-bis(p-dimethylaminophenyl)-tetraphenylcyclodisilazane |
| DSC-4 | N,N'-di-p-biphenyltetramethylcyclo-disilazane |
| DSC-5 | N,N'-di-p-methoxyphenyltetraphenylcyclo-disilazane |
| DSC-6 | N,N'-bis[4-(di-para-tolylamino)phenyl]-tetramethylcyclodisilazane |
| DSC-7 | N,N'-di-para-methoxyphenyl-tetramethylcyclodisilazane |
| DSC-8 | N,N'-di-para-tolyltetramethylcyclo-disilazane |

While the entire hole transporting layer of the organic electroluminesce medium can be formed of a single silazane it is a further recognition of this invention that increased stability can be realized by employing a combination of silazanes.

Any conventional electron injecting and transporting compound or compounds can be employed in forming the layer of the organic luminescent medium adjacent the cathode. This layer can be formed from historically taught luminescent materials, such as anthracene, naphthalene, phenanthrene, pyrene, chyrsene, and perylene and other fused ring luminescent materials containing up to about 8 fused rings as illustrated by Gurnee et al U.S. Pat. No. 3,172,862, Gurnee U.S. Pat. No. 3,173,050, Dresner, "Double Injection Electroluminescence in Anthracene", *RCA Review*, Vol. 30, pp. 322-334, 1969; and Dresner U.S. Pat. No. 3,710,167, cited above. Although such fused ring luminescent materials do not lend themselves to forming thin (<1 μm) films and therefore do not lend themselves to achieving the highest attainable EL devices performance levels, organic EL devices incorporating such luminescent materials when constructed according to the invention show inprovements in performance and stability over otherwise comparable prior art EL devices.

In the organic El devices of the invention it is possible to maintain a current density compatible with efficient light emission while employing a relatively low voltage across the electrodes by limiting the total thickness of the organic luminescent medium to less than 1 μm (10,000 Angstroms). At a thickness of less than 1 82 m an applied voltage of 20 volts results in a field potential of greater than $2\times10^5$ volts/cm, which is compatible with efficient light emission. An order of magnitude reductin (to 0.1 μm or 1000 Angstroms) in thickness of the organic luminescent medium, allowing further reductions in applied voltage and/or increase in the field potential and hence current density, are well within device construction capabilities.

One function which the organic luminescent medium performs is to provide a dielectric barrier to prevent shorting of the electrodes on electrical biasing of the EL device. Even a single pin hole extending through the organic luminescent medium will allow shorting to occur. Unlike conventional EL devices employing a single highly cyrstalline luminescent material, such as anthracene, for example, the EL devices of this invention are capable of fabrication at very low overall organic luminescent medium thicknesses without shortin. One reason is that the presence of three superimposed layers greatly reduces the chance of pin holes in the layers being aligned to provide a continuous conduction path between the electrodes. This in itself permits one or even two of the layers of the organic luminescent medium to be formed of materials which are not ideally suited for film formation on coating while still achieving acceptable EL device performance and reliability.

The preferred materials for forming the organic luminescent medium are each capable of fabrication in the form of a thin film—that is, capable of being fabricated as a continuous layer having a thickness of less than 0.5 μm or 5000 Angstroms.

When one or more of the layers of the organic luminescent medium are solvent coated, a film forming polymeric binder can be conveniently codeposited with the active material to assure a continuous layer free of structural defects, such as pin holes. If employed, a binder must, of course, itself exhibit a high dielectric strength, preferably at least about $2\times10^6$ volt/cm. Suitable polymers can be chosen from a wide variety of known solvent cast addition and condensation polymers. Illustrative of suitable addition polymers are polymers and copolymers (including terpolymers) of styrene, t-butylstyrene, N-vinyl carbazole, vinyltoluene, methyl methacrylate, methyl acrylate, acrylonitrile, and vinyl acetate. Illustrative of suitable condensation polymers are polyesters, polycarbonates, polyimides, and polysulfones. To avoid unnecessary dilution of the active material, binders are preferably limited to less than 50 percent by weight, based on the total weight of the material forming the layer.

The preferred active materials forming the organic luminescent medium are each film forming materials and capable of vacuum vapor deposition. Extremely thin defect free continuous layers can be formed by vacuum vapor deposition. Specifically, individual layer thicknesses as low as about 50 Angstroms can be present while still realizing satisfactory EL device performance. Employing a vacuum vapor deposited porphorinic compound as a hole injecting layer, a film forming silazane as a hole transporting layer (which can in turn be comprised of a monomeric silane layer and a polymeric silazane layer), and a chelated oxinoid compound as an electron injecting and transporting layer, individual layer thicknesses in the range of from about 50 to 5000 Angstroms are contemplated, with layer thicknesses in the range of from 100 to 2000 Angstroms being preferred. It is generally preferred that the overall thickness of the organic luminescent medium be at least about 1000 Angstroms.

The anode and cathode of the organic EL device can each take any convenient conventional form. Where it is intended to transmit light from the organic EL device through the anode, this can be conveniently achieved by coating a thin conductive layer onto a light transmissive substrate—e.g., a transparent or substantially transparent glass plate or plastic film. In one form the organic EL devices of this invention can follow the historical practice of including a light transmissive anode formed of tin oxide or induim tin oxide coated on a glass plate, as disclosed by Gurnee et al U.S. Pat. No. 3,172,862, Gurnee U.S. Pat. No. 3,173,050, Dresner, "Double Injection Electroluminescence in Anthracene", *RCA Review*, vol. 30, pp. 322-334, 1969; and Dresner U.S. Pat. No. 3,710,167, cited above. While any light transmissive polymeric film can be employed as a substrate, Gillson U.S. Pat. No. 2,733,367 and Swindlles U.S. Pat. No. 2,941,104 disclose polymeric films specifically selected for this purpose.

As employed herein the term "light transmissive" means simply that the layer or element under discussion transmits greater than 50 percent of the light of at least one wavelength it receives and preferably over at least a 100 nm interval. Since both specular (unscattered) and diffused (scattered) emitted ligth are desirable device outputs, both translucent and transparent or substantially transparent materials are useful. In most instances the light transmissive layers or elements of the organic EL device are also colorless or of neutral optical density—that is, exhibiting no markedly higher absorption of light in one wavelength range as compared to another. However, it is, of course, recognized that the light transmissive electrode supports or separate superimposed films or elements can be tailored in their light absorption properties to act as emission trimming filters, if desired. Such an electrode construction is disclosed, for example, by Fleming U.S. Pat. No. 4,035,686. The light transmissive conductive layers of the electrodes, where fabricated of thicknesses approximating the wavelengths or multiples of the light wavelengths received can act as interference filters.

Contrary to historical practice, in one preferred from the organic EL devices of this invention emit light through the cathode rather than the anode. This relieves the anode of any requirement that it be light transmissive, and it is, in fact, preferably opaque to light in this form of the invention. Opaque anodes can be formed of any metal or combination of metals having a suitably high work function for anode construction. Preferred anode metals have a work function of greater than 4 electron volts (eV). Suitable anode metals can be chosen from among the high (>4 eV) work function metals listed below. An opaque anode can be formed of an opaque metal layer on a support or as a separate metal foil or sheet.

The organic EL devices of this invention can employ a cathode constructed of any metal, including any high or low work function metal, heretofore taught to be useful for this purpose. Unexpected fabrication, performance, and stability advantages have been realized by forming the cathode of a combination of a low work function metal and at least one other metal. A low work function metal is herein defined as a metal having a work function of less than 4 eV. Generally the lower the work function of the metal, the lower the voltage required for electron injection into the organic luminescent medium. However, alkali metals, the lowest work function metals, are too reactive to achieve stable EL device performance with simple device constructions and construction procedures and are excluded (apart from impurity concentrations) from the preferred cathodes of this invention.

Available low work function metal choices for the cathode (other alkali metals) are listed below by periods of the Periodic Table of Elements and categorized into 0.5 eV work function groups. All work functions provided are taken Sze, *Physics of Semiconductor Devices*, Wiley, N.Y., 1969, p. 366.

| Period | Element | Work Function By eV Group |
|---|---|---|
| 2 | Beryllium | 3.5-4.0 |
| 3 | Magnesium | 3.5-4.0 |
| 4 | Calcium | 2.5-3.0 |
| | Scandium | 3.0-3.5 |
| | Titanium | 3.5-4.0 |
| | Manganese | 3.5-4.0 |
| | Gallium | 3.5-4.0 |
| 5 | Strontium | 2.0-2.5 |
| | Yttrium | 3.0-3.5 |
| | Indium | 3.5-4.0 |
| 6 | Barium | ~2.5 |
| | Lanthanum | 3.0-3.5 |
| | Cerium | 2.5-3.0 |
| | Praseodymium | 2.5-3.0 |
| | Neodymium | 3.0-3.5 |
| | Promethium | 3.0-3.5 |
| | Samarium | 3.0-3.5 |
| | Europium | 2.5-3.0 |
| | Gadolinium | 3.0-3.5 |
| | Terbium | 3.0-3.5 |
| | Dysprosium | 3.0-3.5 |
| | Holmium | 3.0-3.5 |
| | Erbium | 3.0-3.5 |
| | Thulium | 3.0-3.5 |
| | Ytterbium | 2.5-3.0 |
| | Lutetium | 3.0-3.5 |
| | Hafnium | ~3.5 |
| 7 | Radium | 3.0-3.5 |
| | Actinium | 2.5-3.0 |
| | Thorium | 3.0-3.5 |
| | Uranium | 3.0-3.5 |

From the foregoing listing it is apparent that the available low work function metals for the most part belong to the Group IIa or alkaline earth group of metals, the Group III group of metals (including the rare earth metals—i.e. yttrium and the lanthanides, but excluding boron and aluminum), and the actinide groups of metals. The alkaline earth metals, owing to their ready availability, low cost, ease of handling, and minimal adverse environmental impact potential, constitute a preferred class of low work function metals for use in the cathodes of EL devices of this invention. Magnesium and calcium are particularly preferred. Though significantly more expensive, the included Group III metals, particularly the rare earth metals, possess similar advantages and are specifically contemplated as preferred low work function metals. The low work function metals exhibiting work functions in the range of from 3.0 to 4.0 eV are generally more stable than metals exhibiting lower work functions and are therefore generally preferred.

A second metal included in the construction of the cathode has as one primary purpose to increase the stability (both storage and operational) of the cathode. It can be chosen from among any metal other than an alkali metal. The second metal can itself be a low work function metal and thus be chosen from the metals listed above having a work function of less than 4 eV, with the same preferences above discussed being fully applicable. To the extent that the second metal exhibits a low work function it can, of course, supplement the first metal in facilitating electron injection.

Alternatively, the second metal can be chosen from any of the various metals having a work function greater than 4 eV, which includes the elements more resistant to oxidation and therefore more commonly fabricated as metallic compounds. To the extent the second metal remains invariant in the organic EL device as fabricated, it contributes to the stability of the device.

Available higher work function (4 eV or greater) metal choices for the cathode are listed below by periods of the Periodic Table of Elements and categorized into 0.5 eV work function groups.

| Period | Element | Work Function By eV Group |
|---|---|---|
| 2 | Boron | ~4.5 |
| | Carbon | 4.5–5.0 |
| 3 | Aluminum | 4.0–4.5 |
| 4 | Vanadium | 4.0–4.5 |
| | Chromium | 4.5–5.0 |
| | Iron | |
| 4.0–4.5 | | |
| | Cobalt | 4.0–4.5 |
| | Nickel | ~4.5 |
| | Copper | 4.0–4.5 |
| | Zinc | |
| 4.0–4.5 | | |
| | Germanium | 4.5–5.0 |
| | Arsenic | 5.0–5.5 |
| | Selenium | 4.5–5.0 |
| 5 | Molybdenum | 4.0–4.5 |
| | Technetium | 4.0–4.5 |
| | Ruthenium | 4.5–5.0 |
| | Rhodium | 4.5–5.0 |
| | Palladium | 4.5–5.0 |
| | Silver | 4.0–4.5 |
| | Cadmium | 4.0–4.5 |
| | Tin | |
| 4.0–4.5 | | |
| | Antimony | 4.0–4.5 |
| | Tellurium | 4.5–5.0 |
| 6 | Tantalum | 4.0–4.5 |
| | Tungsten | ~4.5 |
| | Rhenium | ~5.0 |
| | Osmium | 4.5–5.0 |
| | Iridium | 5.5–6.0 |
| | Platinum | 5.5–6.0 |
| | Gold | 4.5–5.0 |
| | Mercury | ~4.5 |
| | Lead | ~4.0 |

-continued

| Period | Element | Work Function By eV Group |
|---|---|---|
| | Bismuth | 4.0–4.5 |
| | Polonium | 4.5–5.0 |

From the foregoing listing of available metals having a work function of 4 eV or greater attractive higher work function metals for the most part are accounted for aluminum, the Group Ib metals (copper, silver, and gold), the metals in Groups IV, V, and VI, and the Group VIII transition metals, particularly the noble metals from this group. Aluminum, copper, silver, gold, tin, lead, bismuth, tellurium, and antimony are particularly preferred higher work function second metals for incorporation in the cathode.

There are several reasons for not restricting the choice of the second metal based on either its work function or oxidative stability. The second metal is only a minor component of the cathode. One of its primary functions is to stabilize the first, low work function metal, and, surprisingly, it accomplishes this objective independent of its own work function and susceptibility to oxidation.

A second valuable function which the second metal performs is to reduce the sheet resistance of the cathode as a function of the thickness of the cathode. Since acceptably low sheet resistance levels (less than 100 ohms per square) can be realized at low cathode thicknesses (less than 250 Angstroms), cathodes can be formed which exhibit high levels of light transmission. This permits highly stable, thin, transparent cathodes of acceptable low resistance levels and high electron injecting efficiencies to be achieved for the first time. This in turn permits (but does not require) the organic EL devices of this invention to be constructed with light transmissive cathodes and frees the organic EL devices of any necessity of having a light transmissive anode to achieve light emission through an electrode area.

A third valuable function which the second metal has been observed to perform is to facilitate vacuum vapor deposition of a first metal onto the organic luminescent medium of the EL device. In vapor deposition less metal is deposited on the walls of the vacuum chamber and more metal is deposited on the organic luminescent medium when a second metal is also deposited. The efficacy of the second metal in stabilizing organic EL device, reducing the sheet resistance of thin cathodes, and in improving acceptance of the first metal by the organic luminescence medium is demonstrated by the examples below.

Only a very small proportion of a second metal need be present to achieve these advantages. Only about 0.1 percent of the total metal atoms of the cathode need be accounted for by the second metal to achieve a substantial improvement. Where the second metal is itself a low work function metal, both the first and second metals are low work function metals, and it is immaterial which is regarded as the first metal and which is regarded as the second metal. For example, the cathode composition can range about 0.1 percent of the metal atoms fo the cathode being accounted for by one low work function metal to about 0.1 percent of the total metal atoms being accounted for by a second low work function metal. Preferably one of the two metals account for at least 1 percent and optimally at least 2 percent of the total metal present.

When the second metal is a relatively higher (at least 4.0 eV) work function metal, the low work function metal preferably accounts for greater than 50 percent of the total metal atoms of the cathode. This is to avoid reduction in electron injection efficiency by the cathode, but it is also predicated on the observation that the benefits of adding a second metal are essentially realized when the second metal accounts for less than 20 percent of the total metal atoms of the cathode.

Although the foregoing discussion has been in terms of a binary combination of metals forming the cathode, it is, of course, appreciated that combinations of three, four, or even higher numbers of metals are possible and can be employed, if desired. The proportions of the first metal noted above can be accounted for by any convenient combination of low work function metals and the proportions of the second metal can be accounted for any combination of high and/or low work function metals.

While the second metal or metals can be relied upon to enhance electrical conductivity, their minor proportion of the total cathode metal renders it unnecessary that these metals be present in an electrically conducting form. The second metal or metals can be present as compounds (e.g., lead, tin, or antimony telluride) or in an oxidized form, such as in the form of one or more metal oxides or salts. Since the first, low work function metal or metals account for the major proportion of the cathode metal content and are relied upon for electron conduction, they are preferably employed in their elemental form, although some oxidation may occur on aging.

In depositing the first metal alone onto a substrate or onto the organic luminescent medium, whether from solution or, preferably, from the vapor phase, initial, spatially separated deposits of the first metal form nuclei for subsequent deposition. Subsequent deposition leads to the growth of these nuclei into microcrystals. The result is an uneven and random distribution of microcrystals, leading to a non-uniform cathode. By presenting a second metal during at least one of the nucleation and growth stages and, preferably, both, the high degree of symmetry which a single element affords is reduced. Since no two substances form crystal cells of exactly the same habit and size, any second metal reduces the degree of symmetry and at least to some extent acts to retard microcrystal growth. Where the first and second metals have distinctive crystal habits, spatial symmetry is further reduced and microcrystal growth is further retarded. Retarding microcrystal growth favors the formation of additional nucleation sites. In this way the number of deposition sites is increased and a more uniform coating is achieved.

Depending upon the specific choice of metals, the second metal, where more compatible with the substrate, can produce a disproportionate number of the nucleation sites, with the first metal then depositing at these nucleation sites. Such a mechanism way, if fact, account for the observation that, with a second metal present, the efficiency with which the first metal is accepted by a substrate is significantly enhanced. It has been observed, for example, that less deposition of the first metal occurs on vacuum chamber walls when a second metal is being codeposited.

The first and second metals of the cathode are intimately intermingled, being codeposited. That is, the deposition of neither the first nor second metals is completed before at least a portion of the remaining metal is deposited. Simultaneous deposition of the first and second metals is generally preferred. Alternatively, successive incremental depositions of the first and second metals can be undertaken, which at their limit may approximate concurrent deposition.

While not required, the cathode, once formed can be given post treatments. For example, the cathode may be heated within the stability limits of the substrate in a reducing atmosphere. Other action on the cathode can be undertaken as a conventionally attendant feature of lead bonding or device encapsulation.

EXAMPLES 1–4

A typical electroluminescent cell of the present invention comprises the following layers in the order given glass substrate
anode (Indium Tin Oxide)
anode modification layer
hole transport layer
light emitting layer
cathode (Mg:Ag)

The electroluminescent device is prepared as follows:

(a) A substrate of indium tin oxide (ITO) coated soda lime glass was polished using 0.05 μm alumina abrasive for a few minutes. It was then ultrasonically cleaned in a detergent bath, followed by washing sequentially in a water bath and an isopropyl alcohol bath. Finally, it was degreased in a toluene bath. The ITO is about 1200 angstroms thick and has a sheet resistance of about 20 ohms per square.

(b) The clean ITO/glass was then placed in a conventional vacuum deposition chamber for the deposition of the organic layers. The source was a quartz boat heated by a tungsten filament. The source to substrate distance was typically 15 inches. The source temperature varied with the material to be deposited. The rate of deposition was typically between 2 to 4 angstroms per second. The substrate was usually at ambient temperature. In the following sequence, multilayer organic films were deposited on the ITO/glass:

(a) Copper phthalocyanine (350Å)
(b) Silazane (350Å)
(c) Aluminum oxinate (600Å)

Above, the thickness of the layers, in angstroms, is given in parentheses.

(c) After the deposition of the organic films, the cathode (Mg:Ag) was deposited on top of the organic films, also by vacuum deposition. The Mg:Ag cathode was deposited through a shadow mask using two-source co-evaporation. The rates of deposition, monitored independently by two thickness monitors, were adjusted to give the Mg:Ag alloy film the desired composition. A typical composition is 10:1 in atomic ratio of Mg to Ag. The total deposition rate is about 10 angstroms per sec.

ELECTROLUMINESCENT MEASUREMENTS

In operation, a voltage was applied to the EL cell with a positive potential on the ITO anode and negative potential on the Mg:Ag cathode. The light output from the cell measured using a radiometer. The EL efficiency, defined as the ratio of the light power output from the cell to the electrical power input, is listed in Table 1 for a number of cells using various hole-transport materials. The magnitude of the voltage was typically about 7–10 volts to give a light level output of about 0.1 mw/cm 2 which was clearly visible under ambient lighting conditions.

TABLE 1

El Efficiencies and Oxidation Potentials (Epa) of Silazanes.
Cell Structure: ITO/CuPc anode (350Å), Silazane Layer (350Å), Al (650Å), Mg/Ag cathode (2000Å)

| Example | Silazane | EL Efficiency (watt/watt) @ 0.1 mW/Cm$^2$ | Oxidation Potential Epa (ev) |
|---|---|---|---|
| 1 | DSC-2 | 2.0 E -03 | 1.4 |
| 2 | DSC-5 | 3.0 E -03 | 0.94 |
| 3 | DSC-8[a] | 1.9 E -03 | 1.03 |
| 4 | phenylpoly-silazane[b,c] | 1.4 E -03 | — |

[a]Silazane film was prepared by spin-coating a solution of silazane and polystyrene (1:1 wt. ratio) in toluene (20 mg/ml)
[b]Polysilazane film was prepared by spin-coating a solution of the polysilazane (20 mg/ml) in toluene, spun at 5000 rpm.
[c]The polysilazane used in Example 4 was made by the procedure of Example B.

EXAMPLE 5

An organic EL device was prepared according to procedures described in Examples 1–4. The organic element of the device comprises the following multilayers:

(a) Copper phthalocyanine (350 angstroms);
(b) Silazane (400 angstroms);
(c) Aluminum oxinate (600 angstroms).

The specific silazane layer of this device comprises a vapor deposited film of the silazane produced in Example C. The anode and cathode were, respectively, ITO/glass and Mg:Ag alloy.

The EL device was subjected to a stability test under a continous AC excitation of about 10 volts root mean square (RMS) and a frequency of 1000 hertz. The initial EL brightness of the device was 140 Candela/meter$^2$ (cd/M$^2$) and appeared to be bright green in room light. Operational life exceeded 200 hours. After 200 hours of continuous excitation where the current was adjusted to be constant, the EL device retained about 80% of the initial brightness level. This example demonstrates superior stability of the organic EL cell using silazane as a hole transport agent.

The invention has been described in detail with particular reference to preferred embodiments. It is to be understood that variations and modifications of the above description can be made without departing from the spirit and scope of the appended claims.

What is claimed is:

1. An electroluminescent device comprising in sequence, an anode, an organic hole injecting and transporting zone, an electron injecting and transporting zone, and a cathode; characterized in that said organic hole injecting and transporting zone is comprised of (a) a layer in contact with said anode containing a hole injecting porphyrinic compound and (b) a layer containing a hole transporting silazane, interposed between said hole injecting layer and said electron injecting and transporting zone.

2. An electroluminescent device according to claim 1 wherein said silazane is oxidizable with an oxidation potential within the range of from about 0.5 to about 1.2 electron volts.

3. An electroluminescent device in accordance with claim 2 in which said silazane is a cyclodisilazane.

4. An electroluminescent device in accordance with claim 3 wherein said cyclodisilazane has aryl groups bonded to the nitrogen atoms in the cyclodisilazane ring, such that an aromatic ring in said aryl groups and bonded to said nitrogen atoms, is at least substantially coplanar with said cyclodisilazane ring.

5. An electroluminescent device in accordance with claim 4 wherein said cyclodisilazane has from about 4 to about 8 aromatic rings per molecule.

6. An electroluminescent device of claim 4 in which said cyclodisilazane has a 4-diphenylyl group bonded to each nitrogen atom on the cyclodisilazane ring.

7. An electroluminescent device according to claim 4 wherein each silicon atom in said cyclodisilazane is bonded to an alkyl or aromatic group having up to about 14 carbon atoms.

8. An electroluminescent device in accordance with claim 7 wherein said groups bonded to silicon are selected from methyl and phenyl radicals.

9. An electroluminescent device of claim 8 wherein the nitrogen atoms in said cyclodisilazane ring are bonded to 4-diphenylamino radicals.

10. An electroluminescent device according to claim 1 in which said porphorinic compound is a metal containing porphorinic compound which satisfies the structural formula:

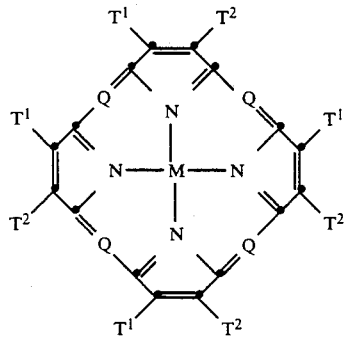

wherein:
Q is —N= or —C(R)=;
M is a metal, metal oxide, or metal halide;
R is hydrogen, alkyl, aralkyl, aryl, or alkaryl, and
T$^1$ and T$^2$ represent hydrogen or together complete a unsaturated 6 membered ring, containing ring atoms chosen from the group consisting of carbon, nitrogen, and sulfur atoms.

11. An electroluminescent device according to claim 1 in which said porphorinic compound is a metal free porphorinic compound which satisfies the structural formula:

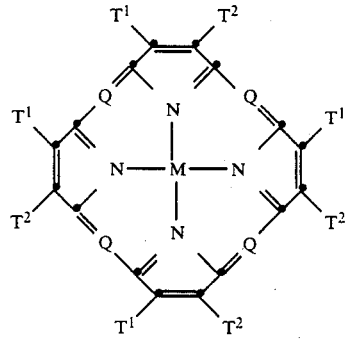

wherein:
Q is —N= or —C(R)=;

M is a metal, metal oxide, or metal halide;
R is hydrogen, alkyl, aralkyl, aryl, or alkaryl, and
$T^1$ and $T^2$ represent hydrogen or together complete a unsaturated 6 membered ring, containing ring atoms chosen from the group consisting of carbon, nitrogen, and sulfur atoms.

12. An electroluminescent device according to claim 1 in which said electron injecting and transporting zone is comprised of a stilbene or chelated oxinoid compound.

13. An electroluminescent device according to claim 12 in which said chelated oxinoid compound is represented by the formula:

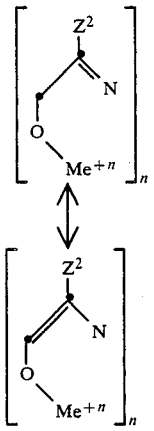

wherein:
Me represents a metal;
n is an integer of from 1 to 3; and
Z independently in each occurrence represents the atoms completing a nucleus having at least two fused aromatic rings.

14. An electroluminescent device comprising in sequence.
an anode,
a hole injecting layer comprised of a porphyrinic compound,
a hole transporting layer comprised of an cyclodisilazane,
an electron injecting and transporting layer comprised of a chelated oxinoid compound, and
a cathode comprised of a layer consisting essentially of a plurality of metals other than alkali metals, at least one of said metals having work function greater than 4 eV.

15. An electroluminescent device according to claim 14 in which said anode is opaque and said cathode is light transmissive.

16. An electroluminescent device according to claim 14 in which said metal having a work function of less than 4 eV includes at least one alkaline earth metal, rare earth metal, or Group III metal.

17. An electroluminescent device according to claim 14 in which said cathode includes at least one metal having a work function greater than 4 eV.

18. An electroluminescent device according to claim 1, wherein said silazane is a polymeric material having a plurality of repeating units having the formula:

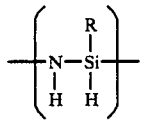

said units being linked together by $Si_2N_2$ bridges having the formula:

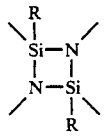

wherein:
each R is independently selected from the class consisting of hydrogen, lower alkyl groups having from 1 to about 6 carbon atoms, lower alkoxy group having from 1 to about 6 carbon atoms, substituted or unsubstituted vinyl groups, substituted or unsubstituted lower aryl groups having from 6 to about 10 carbon atoms, tri(lower)alkyl and di(lower)alkylsilyl groups and di(lower)alkylamino groups; and
n is an integer greater than 1; said units being cyclic, linear or branched.

19. An electroluminescent device according to claim 1 wherein said silazane has the formula:

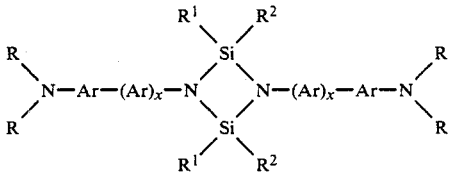

wherein each Ar is an aryl radical having from 6 to about 14 carbon atoms, x is a whole number selected from 0 and 1, and R, $R^1$, and $R^2$ are alkyl or aryl radicals having up to about 14 carbon atoms, preferably Ar is a phenyl radical, each x is equal to 1, each R is a phenyl radical, and $R^1$ and $R^2$ are selected from methyl and phenyl radicals.

20. Cyclodisilazane having the formula:

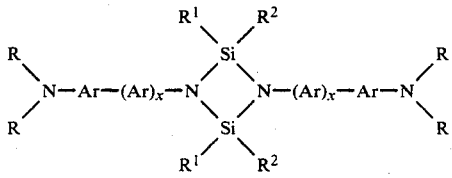

wherein each Ar is an aryl radical having from 6 to about 14 carbon atoms, x is a whole number selected from 0 and 1, and R, $R^1$, and $R^2$ are alkyl or aryl radicals having up to about 14 carbon atoms, preferably Ar is a phenyl radical, each x is equal to 1, each R is a phenyl radical, and $R^1$ and $R^2$ are selected from methyl and phenyl radicals.

* * * * *